US008636232B2

(12) United States Patent
Metzger

(10) Patent No.: US 8,636,232 B2
(45) **Date of Patent: *Jan. 28, 2014**

(54) METHOD FOR SPRAYING A MEDIUM AND SPRAYING NOZZLE

(75) Inventor: Harry Metzger, Kerava (FI)

(73) Assignee: Marioff Corporation Oy (FI)

( * ) Notice: Subject to any disclaimer, the term of this patent is extended or adjusted under 35 U.S.C. 154(b) by 2 days.

This patent is subject to a terminal disclaimer.

(21) Appl. No.: 13/154,951

(22) Filed: Jun. 7, 2011

(65) Prior Publication Data

US 2011/0272486 A1 Nov. 10, 2011

Related U.S. Application Data

(62) Division of application No. 11/791,794, filed as application No. PCT/FI2005/000509 on Nov. 25, 2005, now Pat. No. 8,025,244.

(30) Foreign Application Priority Data

Dec. 15, 2004 (FI) ..... 20041606

(51) Int. Cl.
*B05B 1/34* (2006.01)

(52) U.S. Cl.
USPC ..... 239/487; 239/424; 239/8

(58) Field of Classification Search
USPC ..... 239/487, 424, 428, 421, 461, 463, 466, 239/468, 472, 490, 492, 8, 10
See application file for complete search history.

(56) References Cited

U.S. PATENT DOCUMENTS 3,182,916 A 5/1965 Ferdinand
3,703,259 A * 11/1972 Sturgess et al. ..... 239/400
4,358,058 A 11/1982 Bierman
4,415,275 A 11/1983 Dietrich
4,431,403 A 2/1984 Nowak et al.
4,480,925 A 11/1984 Dietrich
4,624,414 A 11/1986 Ferrazza
4,842,197 A 6/1989 Simon et al.
4,884,746 A 12/1989 Lewis
5,351,891 A 10/1994 Hansen et al.
5,590,719 A 1/1997 McLoughlin et al.
5,603,211 A 2/1997 Graves
5,697,553 A * 12/1997 Stotts ..... 239/8
6,129,154 A 10/2000 Hoffmann et al.
6,766,864 B2 7/2004 Clauss et al.
8,025,244 B2 * 9/2011 Metzger ..... 239/487

FOREIGN PATENT DOCUMENTS

DE 270 664 A1 8/1989
EP 671216 B1 3/2000

OTHER PUBLICATIONS

Candian Office Action, dated May 3, 2012, for Canadian Patent Application No. 2,589,504, filed Nov. 25, 2005, pp. 1-3, published by the Canadian Patent Office.

* cited by examiner

*Primary Examiner* — Davis Hwu
(74) *Attorney, Agent, or Firm* — Cantor Colburn LLP

(57) ABSTRACT

A method for spraying a medium mist, particularly a medium mist used in firefighting, over a large area. In the method, at least two sprays of medium mist are formed, of which a first spray is within a second medium mist spray at least at or near the spraying point. During the formation of the sprays, the medium is set into a swirling motion at least before the discharge opening of the nozzle used to form each spray and/or at least before the sprays are mixed with each other. The swirling directions of the medium in different sprays are opposite to each other, whereby a preferably homogeneous mist spray spread over a large area is achieved.

12 Claims, 2 Drawing Sheets

METHOD FOR SPRAYING A MEDIUM AND SPRAYING NOZZLE

RELATED APPLICATION

This is a divisional of application Ser. No. 11/791,794 filed on May 25, 2007 now U.S. Pat. No. 8,025,244, which is International Application PCT/FI2005/000509 filed on Nov. 25, 2005, which designated the U.S., claims the benefit thereof and incorporates the same by reference.

BACKGROUND OF THE INVENTION

The present invention relates to a method as defined in the preamble of claim 1 for spraying a medium mist, especially a medium mist used in firefighting, in which method at least two sprays of medium mist are formed, of which a first spray is within a second medium mist spray at least at or near the spraying point.

The invention also relates to a spraying nozzle as defined in claim 6, comprising a frame with an inlet formed in it, a first nozzle chamber with a first nozzle opening, a second nozzle chamber with a discharge opening formed as a ring-like opening around the discharge opening of the first nozzle chamber, and at least one medium passage from the inlet to each nozzle chamber.

On the other hand, various spraying nozzles for producing a liquid mist are known. In prior art, nozzles using a so-called swirl chamber inside the nozzle are known. Even with a low pressure, such nozzles can easily produce a good uniform spray, which "swirls" because the water is passed tangentially into the swirl chamber and the mist spray is discharged out of the nozzle in an orbicular fashion. In this case, too, the cross-sectional, pattern of the spray produced as seen perpendicularly to the main spraying direction is circular, in other words, the middle area within the spray is not covered but remains void of mist. It has been possible to correct this deficiency by using a nozzle that forms a full spraying cone. In addition to the foregoing, nozzles of this type produce a spray that conies out straight from the center of the nozzle. This should make the spray a full cone. This may work if the swirling circle is not very large and the pressure is fairly high. Experience shows, however, that the middle spray forms large drops, and therefore the mist produced by the nozzle is not of uniform quality. A nozzle applying such a solution is disclosed in U.S. Pat. No. 6,129,154. This solution, too, involves the problem that the mist can not be spread over a sufficiently large area, especially when relatively low pressures are used.

Especially fire extinguishing systems using water mist require a spray that covers a sufficiently large area. The sprinkler nozzles used in traditional fire extinguishing systems are provided with a barrier plate placed in front of the spray discharged from the nozzle head to spread the spray over a large area. Such sprays are not mist-like and these nozzle heads involve the problem that they leave a void in the middle area of the spray, where no extinguishing medium can be sprayed by the nozzle head.

The object of the present invention is to create a completely new type of solution that makes it possible to produce a homogeneous spray that is spread over a large area. Thus, the aim is to spread the mist over a sufficiently large area and so that a good mist coverage is achieved and, on the other hand, so that the flow of the sprayed medium is about the same in the whole coverage area. It is thus also an aim to ensure that no so-called voids are left in the spraying pattern produced. Yet another objective of the invention is to create a nozzle especially for use in connection with relatively low pressures. Yet another objective of the invention is to achieve a solution for a nozzle for use in firefighting that is especially suited for the spraying of water mist.

BRIEF DESCRIPTION OF THE INVENTION

The method of the invention is mainly characterized in that, during the formation of the sprays, the medium is set into a swirling motion at least before the discharge opening of the nozzle used to form each spray and/or at least before the sprays are mixed with each other, and that the swirling directions of different sprays and/or of the medium used to produce them are opposite to each other, whereby a preferably homogeneous mist spray spread over a large area is achieved.

The nozzle of the invention is mainly characterized in that the spraying nozzle comprises means for conducting a spraying medium into a first spraying chamber in such a way that the spraying medium is caused to swirl in a first direction, and means for conducting a spraying medium into a second chamber in such a way that the spraying medium is caused to swirl in a second direction, which is substantially opposite to the swirling direction of the medium conveyed into the first chamber.

The solution of the invention has numerous significant advantages. Using the method and nozzle of the invention, it is possible to produce a spray that covers a large area and has no so-called voids within it. By using an arrangement where nested, radially adjacent sprays are caused to swirl in different directions about the axis of the main direction of motion, it has unexpectedly proved possible to prevent the formation of void areas in the inner parts of the spray, even when the pressure is increased. Using the nozzle head of the invention, it is possible to produce a mist spray of relatively uniform and good quality that is very well suited for use in fire extinguishing systems and devices. For the nozzle head of the invention, a very compact construction has been achieved.

In this context, 'spraying nozzle' refers to a nozzle combination or nozzle head that comprises a spraying nozzle combination according to the invention.

'Relatively low pressure' here mainly refers to pressures below 35 bar, typically pressures below 25 bar, preferably pressures below 15 bar, especially pressures of about 5-12.5 bar; in some special cases even pressures below 5 bar or over 35 bar.

BRIEF DESCRIPTION OF THE FIGURES

In the following, the invention will be described in detail with reference to an example and the attached drawing, wherein.

DETAILED DESCRIPTION OF THE INVENTION

Figure 1:
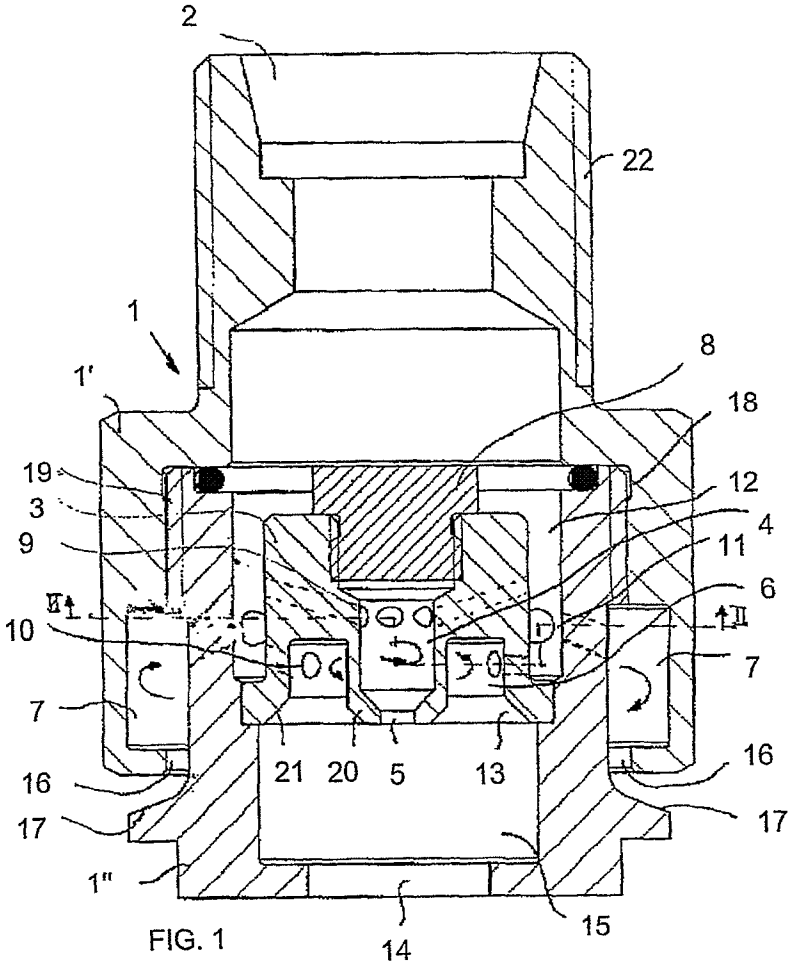
FIG. 1 presents a nozzle according to the invention in cross-sectional view.
Figure 2:
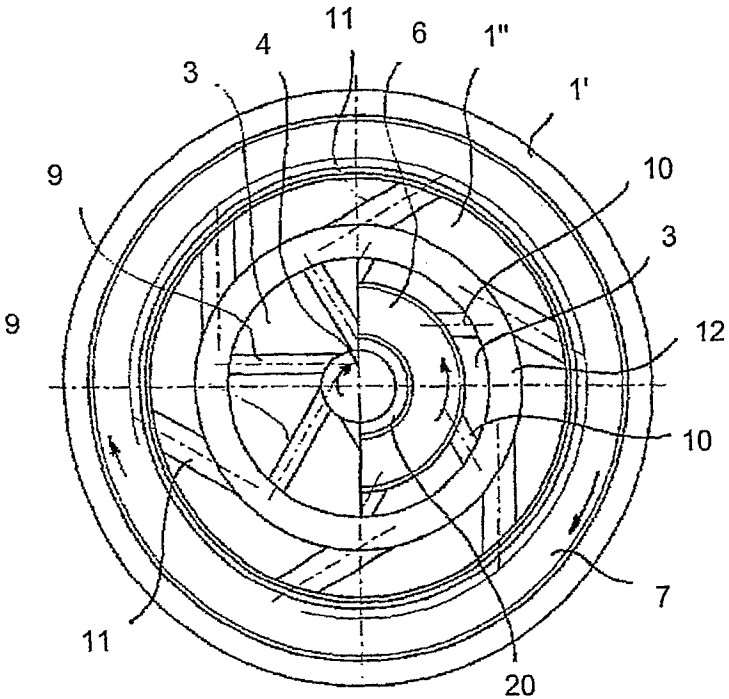
FIG. 2 presents a cross-section along line II-II in FIG. 1, and FIG. 3 additionally presents an illustrative representation of the nozzle of the invention with the directions of the sprays schematically indicated.
Figure 3:
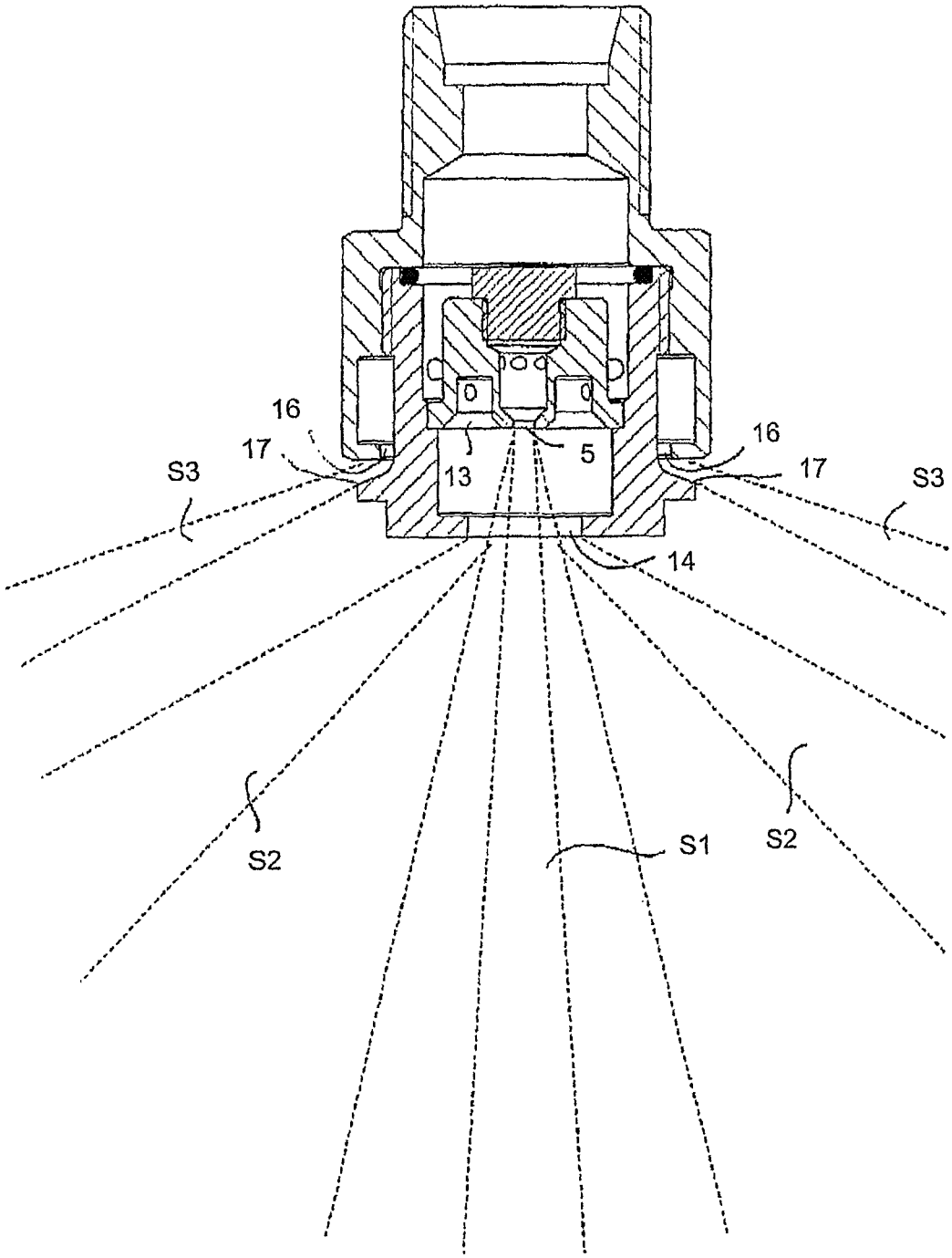

The figures present a nozzle solution according to the invention. The nozzle head comprises a frame 1 with an inlet 2 formed in it for conveying a medium to be sprayed. Formed in the frame are threads 22 for connection of the nozzle head to a medium conductor or equivalent. The frame comprises a first spraying chamber 4 and a second nozzle chamber 6, which preferably has been formed as a ring-like nozzle chamber around the first nozzle chamber 4, at a distance from the nozzle opening 5 of the first nozzle chamber. In the embodiment illustrated in the figure, the frame consists of an upper frame 1' and a lower frame 1". The lower frame 1" is arranged in the upper frame 1' in threads formed in its bore, into which threads the counter-threads of the lower frame fit. Arranged inside the lower frame in the embodiment in FIG. 3 is a nozzle body 3 with bores formed in it for the nozzle chambers and, on the other hand, for medium conduits. The innermost bore in the nozzle body 3 is for the first nozzle chamber 6. The first nozzle chamber 4 is mainly cylindrical, and in the embodiment according to FIG. 1 it tapers in its lower part in the form of a truncated cone towards the nozzle opening 5. Arranged in the upper part of the first nozzle chamber 4 as seen in the figure is a plug element 8 to prevent the medium from getting into the nozzle chamber at least partly via the bore of the cylindrical space. Formed in the first chamber 4 is at least one first medium conduit 9. Typically, several first medium conduits 9 are provided. The medium conduit 9 has been arranged to conduct a spraying medium into the spraying chamber 4 typically at least partly tangentially so as to effect a swirling motion of the medium in the spraying chamber. This swirling motion is visualized by the arrows shown in the chambers. In the first chamber 4, the swirling motion takes place in a first direction, e.g. clockwise, as indicated in FIG. 2.

The first nozzle opening 5 opens into the mixing chamber 15 of the nozzle head, from where a discharge opening 14 leads to the outside of the nozzle head.

A second spraying chamber 6 has been formed as a ring-like nozzle chamber around the first spraying chamber 4, with a wall 20 separating the chambers 4, 6 from each other. From the ring-like nozzle chamber 6, a ring-like opening leads into the mixing chamber 15. The lateral surfaces of the chamber form a ring-like opening 13 expanding from the second spraying chamber 6 towards the mixing chamber 15. Arranged in the second spraying chamber 6 is at least one second medium conduit 10. The second medium conduit 10 has been arranged to conduct the spraying medium into the spraying chamber 6 typically at least partly tangentially so that a swirling motion of the medium is produced in the second spraying chamber 6. The medium conduits 10 of the second spraying chamber 6 have been arranged to direct the spraying medium in the chamber in such a way that an opposite swirling direction relative to the swirling direction in the first chamber 4 is achieved. In this case, the motion takes place in the other direction, such as e.g. counter-clockwise, as illustrated in FIG. 2.

In the embodiment in the figure, a nozzle head is presented that additionally comprises a third spraying chamber 7. The third spraying chamber 7 is also a ring-like chamber that encompasses the second spraying chamber 6 and the first spraying chamber 4. Arranged in the third spraying chamber 7 is at least one third medium conduit 11. This medium conduit 11 has been arranged to conduct the spraying medium into the spraying chamber typically at least partly tangentially so as to produce a swirling motion of the medium in the third spraying chamber 7. The medium conduits 11 of the third spraying chamber have been arranged to direct the spraying medium in the chamber 7 in such a way that an opposite swirling direction relative to the swirling direction in the second chamber 6 is achieved. In this case the swirling motion takes place in the first direction, such as e.g. clockwise, as illustrated in FIG. 2.

Chamber 7 has been formed mainly in the lower part of the upper frame 1', where a ring-like groove has been machined, so that the outer circumferential surface and side edges of the groove form the outer wall of the chamber and likewise its bottom and upper wall. In the solution presented in the figure, the inner wall of the third spraying chamber consists of that part of the outer wall of the lower frame 1" which is located opposite to the groove. In the figure, a ring-like nozzle opening 16 has been formed in the lower part of the chamber, Formed in the lower frame near the opening 16 is a guide surface 17 to direct a third spray to be sprayed from the opening. In the solution illustrated in the figure, the guide surface extends as a curvature from the initially vertical side surface, whereafter it extends as an oblique surface, guiding the spray obliquely sideways, with the result that the spray is a very wide cone, roughly resembling the surface shape of e.g. the canopy of an open umbrella. In some embodiments, the nozzle head may also be implemented without a third spraying chamber 7. In this case, the upper frame need not be provided with chamber space 7 and a medium conduit from the inlet into spraying chamber 7.

The method of the invention relates to the spraying of a medium mist, especially a medium mist used in firefighting. In the method, at least two medium mist sprays are formed, of which a first spray S1 is within a second medium mist spray S2 at least at the spraying point or near it. During the formation of the sprays, the medium is set into a swirling motion at least before the discharge opening 5, 13 of the nozzle used to form each spray S1, S2 and/or at least before the sprays S1, S2 are mixed with each other. The swirling directions of different sprays S1, S2 and/or of the medium used to produce them are opposite to each other, whereby a preferably homogeneous mist spray spread over a large area is achieved. The swirling directions are indicated by arrows in the embodiments illustrated in the figures.

According to a preferred embodiment, the method further comprises the formation of at least one third spray S3, within which the first spray S1 and the second spray S2 remain, at least at or near the spraying point, so that the swirling directions of the medium of each adjacent spray S1, S2 and S2, S3 are opposite to each other at least before the discharge opening 5, 13, 16 of the nozzle used to form each spray and/or at least before the adjacent sprays S1, S2 and S2, S3 are mixed with each other.

The medium is fed into the nozzle chamber 4, 6, 7 of the spraying nozzle forming each spray so as to produce a swirling motion of the medium before the nozzle opening/discharge opening 5, 13, 16.

In the method, the first spray S1 is delivered via the discharge opening 5 of a first nozzle chamber and the second spray S2 via the discharge opening 13 of a second nozzle chamber. The latter discharge opening 13 has a ring-like shape and, as seen in the direction perpendicular to the spraying direction, surrounds the first nozzle opening 5.

The spraying medium is a liquid or a mixture of a liquid and a gas.

The spraying nozzle of the invention comprises a frame 1 with an inlet 2 formed in it, a first nozzle chamber 4 with one first nozzle opening 5, a second nozzle chamber 6 with a ring-like discharge opening 13 surrounding the discharge opening of the first nozzle chamber, and at least one medium passage 9, 10 from the inlet 2 into each spraying chamber 4, 6.

The spraying nozzle comprises means 9 for conducting a spraying medium into the first spraying chamber 4 so as to cause the spraying medium to swirl in a first direction, and means 10 for conducting a spraying medium into the second spraying chamber 6 so as to cause the spraying medium to swirl in a second direction, which is substantially opposite to the swirling direction of the medium conducted into the first chamber 4.

The spraying nozzle of the invention, which, according to a second embodiment, comprises a frame 1 with an inlet 2 formed in it, a first nozzle chamber 4 with one first nozzle opening 5, a second nozzle chamber 6 with a ring-like discharge opening 13 surrounding the discharge opening 5 of the first nozzle chamber, and a third nozzle chamber 7 with a ring-like discharge opening 16 arranged around the discharge opening 13 of the second nozzle chamber 6. The spraying nozzle comprises at least one medium passage 9; 10; 11 from the inlet 2 into each spraying chamber 4, 6, 7.

The spraying nozzle comprises means 9 for conducting a spraying medium into the first spraying chamber 4 so as to cause the spraying medium to swirl in a first direction, and means 10 for conducting a spraying medium into the second spraying chamber 6 so as to cause the spraying medium to swirl in a second direction, which is substantially opposite to the swirling direction of the medium conducted into the first chamber 4, and additionally means for conducting a spraying medium into the third chamber 7 so as to cause the medium to swirl in the first direction, which is opposite to the swirling direction of the medium conducted into the second chamber 6.

According to an embodiment, the means 9, 10, 11 comprise at least one medium passage 9, 10, 11 through which a spraying medium is conducted into at least one nozzle chamber at least partly in a substantially tangential direction. In this way, the medium is set into a swirling motion in the spraying chamber, and this motion also appears as a swirling motion of the spray about an axis parallel to the main direction of motion of the spray. Alternatively, it is possible to use rotor elements known in themselves, arranged in the spraying chamber to produce a swirling motion of the spray about the axis of the main direction of motion.

Each chamber 4, 6, 7 comprises at least one medium conduit 9, 10, 11, through which the spraying medium is conducted into the spraying chamber. From the solution illustrated in FIG. 2, it can be seen that there are several medium conduits 9, 10, 11 leading into each chamber.

In the embodiment presented in the figures, the spraying nozzle comprises a mixing chamber 15, and the nozzle opening 5 of the first spraying chamber 4 and the ring-like nozzle opening 13 of the second spraying chamber 6 open into this mixing chamber, from where the medium sprays of the first spraying chamber and the second spraying chamber are passed out through a discharge opening 14.

The third spraying chamber 7 has a ring-like discharge opening 16. Preferably arranged near the spraying opening is a guide surface, by means of which the spray can be guided in a desired direction. This arrangement makes it possible to produce a spray that is typically directed to a larger area than the previous sprays, enclosing the area to which the sprays of the first nozzle and the second nozzle are directed.

In the embodiment illustrated in FIG. 3, the medium spray S1 sprayed from the first spraying chamber 4 forms a conical spray, the spray S2 from the second spraying chamber 6 a ring-like, conical spray, inside which the first spray S1 is sprayed, while the spray from the third spraying chamber is a ring-like spray S3 spread over a larger area, within which the first spray S1 and the second spray S2 are sprayed.

The nozzle head is intended preferably for a spraying medium consisting of a liquid or a mixture of a liquid and a gas. In firefighting applications, typically a non-inflammable liquid, such as water, and a suitable gas, e.g. nitrogen, are used. It is naturally also possible to use other gases applicable in firefighting.

The spraying nozzle may further comprise at least one ring-like nozzle arranged on a circle larger than the discharge opening of the third nozzle. It is conceivable that nozzle combinations in which the swirling directions of each pair of adjacent sprays about the axis of the main direction of motion are mutually opposite can be created in the manner described in the invention.

In the solution of the invention, the swirling motion of the medium in different spraying chambers 4, 6, 7 has been arranged to take place alternately in different directions (clockwise and counter-clockwise), so that the swirling directions of the medium flows used to form the sprays in each pair of adjacent nested sprays are opposite to each other. An unexpected result achieved by this arrangement is a uniform and effective spreading of the spraying medium over the spraying area of the nozzle head, with no substantial so-called voids. In addition, the swirling motion of the medium causes the mist to penetrate effectively, a solution very well applicable for firefighting being thus achieved.

In FIG. 3, the sprays from different nozzles are schematically visualized by broken lines. Spray S1 from the first nozzle 5, spray S2 from the second nozzle 13, 14 and spray S3 from the third nozzle 16. It is to be noted that the mist is also spread into the area between the sprays S1, S2 and S2, S3 from the nozzles, a very good coverage being thus achieved in the entire large conical area.

The nozzle head of the invention is very well suited for use for the spraying of a mist of a fire extinguishing medium, especially for the spraying of water mist. The nozzle head is suited for use especially in connection with relatively low medium pressures. As working pressures, pressures below 35 bar are generally used. The pressures typically used are pressures below 25 bar, preferably pressures below 15 bar, especially pressures of about 5-12.5 bar. In some special cases, even pressures below 5 bar or over 35 bar.

It is obvious to the person skilled in the art that the invention is not limited to the embodiments described above, but that it may be varied within the scope of the claims presented below. Features that may have been presented in the description together with other features can also be used separately from each other if necessary. It is also conceivable that a spraying nozzle according to the invention can even be produced as a combination of separate nozzles having the required properties.

The invention claimed is:

1. A method for spraying a medium mist from a nozzle to an outside environment for fire suppression to the outside environment, wherein the medium comprises least two sprays of which a first spray is formed within a second spray at least at or near a spraying point, the method comprising:

imparting a swirling motion to the first spray, wherein the first spray comprises a liquid composition;

imparting another swirling motion to the second spray, wherein the second spray comprise the liquid composition and wherein the swirling motion imparted to the first and the second spray is imparted before a first discharge opening and a second discharge opening for the first spray and the second spray, respectively, of the nozzle used to form the first spray and the second spray, wherein swirling directions imparted to the first spray and the second spray are opposite to each other, whereby a homogeneous mist spray spread over a large area is achieved to provide the fire suppression to the outside environment; and ejecting the first spray to the outside environment via the first discharge opening of a first nozzle chamber and ejecting the second spray to the outside environment via the second discharge opening of a second nozzle chamber, wherein the second discharge opening comprises a ring-like shape and surrounds a first opening of the first discharge opening, wherein the medium is fed into the first, the second, and a third nozzle chamber of the nozzle forming each spray in such a way that a swirling motion of the medium is set up before the first opening of the first discharge opening.

2. A method according to claim 1, further comprising the formation of at least one third spray, within which the first spray and the second spray remain at least at or near the spraying point, so that the swirling directions of each adjacent spray are opposite to each other at least before the first, the second, a third discharge opening of the nozzle used to form each spray.

3. A method according to claim 1, wherein the first spray is delivered via the first discharge opening of the first nozzle chamber and the second spray via the second discharge opening of the second nozzle chamber, which the second discharge opening has the ring-like shape and surrounds the first nozzle opening in a direction perpendicular to a spraying direction.

4. A spraying nozzle operable to convey a spraying fluid to an outside environment for fire suppression to the outside environment, comprising a frame with an inlet formed therein, a first nozzle chamber with one first nozzle opening, a second nozzle chamber with a discharge opening, and at least one medium passage from the inlet to each spraying chamber, wherein the spraying nozzle further comprises a first conduit operable to conduct a liquid spraying medium into the first spraying chamber in such a way that the spraying medium is caused to swirl in a first direction, and a second conduit operable to conduct the liquid spraying medium into the second chamber in such a way that the liquid spraying medium is caused to swirl in a second direction, which is substantially opposite to the swirling direction of the medium conveyed into the first chamber, wherein the discharge opening of the second nozzle chamber is formed as a ring-like opening around the discharge opening of the first nozzle chamber, wherein the spraying fluid is ejected from the spraying nozzle to the outside environment to provide the fire suppression to the outside environment, wherein the medium is fed into the first, the second, and a third nozzle chamber of the nozzle forming each spray in such a way that a swirling motion of the medium is set up before the first opening of the discharge opening of the first nozzle chamber.

5. A spraying nozzle according to claim 4, wherein the spraying nozzle further comprises the third nozzle chamber, whose discharge opening surrounds the discharge openings of the second chamber and the first chamber, and a third conduit operable to conduct a spraying medium into the third chamber in such a way that the medium is caused to swirl in a first direction, which is opposite to the swirling direction of the medium conducted into the second chamber.

6. A spraying nozzle according to claim 4, wherein the first, the second, and the third conduit comprise at least one medium passage through which the spraying medium is conducted into at least one nozzle chamber at least partly in a substantially tangential direction.

7. A spraying nozzle according to claim 4, wherein each chamber comprises at least one medium conduit, through which the spraying medium is conducted into the spraying chamber.

8. A spraying nozzle according to claim 4, wherein the spraying nozzle comprises a mixing chamber, and the nozzle opening of the first spraying chamber and the ring-like nozzle opening of the second spraying chamber open into the mixing chamber, from where the medium sprays of the first spraying chamber and the second spraying chamber are passed out through a discharge opening.

9. A spraying nozzle according to claim 5, wherein the third spraying chamber has a ring-like discharge opening.

10. A spraying nozzle according to claim 4, wherein the medium spray sprayed from the first spraying chamber forms a conical spray and the spray from the second spraying chamber a ring-like conical spray, inside which the first spray is sprayed.

11. A spraying nozzle according to claim 5, wherein the spray from the third spraying chamber is a ring-like spray which is spread over a larger area and inside which the first spray and the second spray are sprayed.

12. A spraying nozzle according to claim 4, wherein the spraying nozzle further comprises at least one ring-like nozzle, which is arranged on a circle larger than a discharge opening of a third nozzle.

* * * * *